US012163769B2

(12) United States Patent
Polovnev

(10) Patent No.: US 12,163,769 B2
(45) Date of Patent: Dec. 10, 2024

(54) CAVITATING PROJECTILE OF FIREARM AMMUNITION

(71) Applicant: Andrey Albertovich Polovnev, Moscow (RU)

(72) Inventor: Andrey Albertovich Polovnev, Moscow (RU)

( * ) Notice: Subject to any disclaimer, the term of this patent is extended or adjusted under 35 U.S.C. 154(b) by 167 days.

(21) Appl. No.: 17/638,282

(22) PCT Filed: Jun. 30, 2020

(86) PCT No.: PCT/RU2020/000318

§ 371 (c)(1),
(2) Date: Mar. 8, 2023

(87) PCT Pub. No.: WO2021/040564

PCT Pub. Date: Mar. 4, 2021

(65) Prior Publication Data

US 2023/0243629 A1 Aug. 3, 2023

(30) Foreign Application Priority Data

Aug. 27, 2019 (RU) ..... 2019127011

(51) Int. Cl.
*F42B 10/46* (2006.01)
*F42B 10/08* (2006.01)
(Continued)

(52) U.S. Cl.
CPC ..... *F42B 10/46* (2013.01); *F42B 10/08* (2013.01); *F42B 10/42* (2013.01); *F42B 15/22* (2013.01)

(58) Field of Classification Search
CPC ..... F42B 10/08; F42B 10/38; F42B 10/42; F42B 4615/20; F42B 4615/22
(Continued)

(56) References Cited

U.S. PATENT DOCUMENTS 4,517,897 A 5/1985 Kneubiihl
8,082,851 B2 * 12/2011 Polovnev ..... F42B 15/22 102/518

FOREIGN PATENT DOCUMENTS

RU 2268455 C1 1/2006
RU 2316718 C1 2/2008

* cited by examiner

*Primary Examiner* — Joshua E Freeman
*Assistant Examiner* — Benjamin S Gomberg
(74) *Attorney, Agent, or Firm* — Todd A. Serbin; Maynard Nexsen PC

(57) ABSTRACT

Firearm ammunition, primarily for destroying underwater targets in the case of underwater or air-to-water fire also can be used to fire at targets in the air. A cavitating projectile of firearm ammunition comprises a secant nose surface with a cavitating edge of diameter (d), a head portion, a central portion and an aft portion with a gliding surface, maximum diameter of which is equal to a caliber projectile (D). In a plane of an axial longitudinal section of the projectile, the current diameter ($D_X$) at a length ($L_X$) from the cavitating edge (d) to the projectile caliber (D) is limited by the equation: $D_X=d\times[1+(L_X/d)\times 2\pi\times\sin\varphi/\pi]^N$, wherein N=0.25-0.40. The cavitating projectile results in an increase in target destruction efficiency due to the loss of stability and turning over in a heterogeneous target.

7 Claims, 3 Drawing Sheets

(51) Int. Cl.
*F42B 10/42* (2006.01)
*F42B 15/22* (2006.01)

(58) Field of Classification Search
USPC ..... 102/301
See application file for complete search history.

CAVITATING PROJECTILE OF FIREARM AMMUNITION

RELATED APPLICATIONS

This application is a U.S. national phase application, claiming priority under 35 U.S.C. § 371 to PCT application PCT/RU2020/000318, filed Jun. 30, 2020, claiming priority to Russian Patent Application No. 2019127011, filed on Aug. 27, 2019. The contents of these applications are incorporated herein by reference in their entireties.

TECHNICAL FIELD

The invention relates to firearm ammunition, including a propellant charge and a cavitating projectile, and intended for the destruction of primarily underwater targets during underwater firing and at firing from the air into the water. Firing from the air into water at underwater targets is possible from any kind of standard weapon. The expediency of underwater firing is determined for each weapon system individually. If necessary, underwater ammunition with a cavitating projectile can be used to fire at targets in the air.

BACKGROUND OF THE INVENTION

Mass passion for underwater sports and underwater hunting involves creation of cavitating projectiles for sports firing at underwater targets and underwater hunting using rifled and smooth-bore firearms, including recoilless underwater firearms.

To successfully hit targets in water and air environments, cavitating projectiles are to remain stable when flying in the air and moving in water, as well as have the ability to pass through the interface of two environments (air/water and water/air).

From technical literature it is known that high-speed movement of the cavitating projectile in water is accompanied by the formation of a natural cavity, which widens behind the cavitating edge of its secant nose surface. The contour of that cavity (W) is close to the ellipsoid of revolution, wherein its initial part corresponds to the asymptotic law of jet spread and is constant on the most part of the underwater trajectory (see GUREVICH M. I. "Teoria struy idealnoy zhidkosti"—Moscow, Physical-mathematical Literature Publishing, 1961, pages 160-168 and 410-460, also YAKIMOV Yu. L. "Ob integrate energii pri dvizhenii s malymi tchislamy kavitatsii i predelnyh formah kaverny"—Academy of Science of the USSR, Fluid and Gas, No. 3, 1983 pages 67-70).

It is also well known that the largest diameter of the cavity ($D_K$) depends on the cavitation number (σ), the cavitating edge diameter (d) of the cavitating projectile and cavitation drag index ($c_X$) of its nose surface:

$$D_K=d\times(c_X/\sigma)^{0.5}$$

The cavitation number (σ) depends on the cavitating projectile velocity (V), hydraulic pressure (P), the water vapor pressure in the cavity ($P_0$~0.02 kg/cm$^2$~0.002 MPa) and the water density (φ:

$$\sigma=2\times(P-P_0)/\rho\times V^2$$

The cavity length ($L_K$) depends on its largest diameter ($D_K$):

$$L_K=D_K\times\sigma^{-0.5}\times(\ln\sigma^{-1}+\ln\ln\sigma^{-1})^{0.5}$$

During cavitation movement in the cavity, the cavitating projectile spends energy to overcome the force of cavitation drag (F), which depends on the diameter of its cavitating edge (d), cavitating drag index ($c_X$) of its nasal surface, water density (φ and the current velocity (V) of the cavitating projectile:

$$F=c_x\times\pi\times d^2\times\rho\times V^2/8$$

Stabilization of the cavitating projectile movement in the cavity is provided by its gliding surface by means of one-sided periodic wetting and gliding along the cavity contour (W). Therefore, the largest diameter of the circle that circumscribes the cross-section of the gliding surface defines the cavitating projectile caliber (D). At the moment of the cavitating projectile gliding in the cavity, gaps ($\delta_N$) are formed between the cavity contour (W) and the cavitating projectile outside surface on the side of the gliding surface, whereby the minimum gaps (δ) should not allow any frontal surface of the cavitating projectile located in front of its center of mass to touch the cavity contour (W) and to flush. However, an additional decrease in the minimum gaps (δ) can be caused by an increase in the amplitude of angular oscillations of the cavitating projectile in the cavity during inertial wetting of the gliding surface beyond the cavity contour (W). In this case, water particles (water vapor) breaking away from the cavitating edge of the nasal surface and flowing into the gaps ($\delta_N$) between the cavitating projectile outside the surface and the cavity contour (W) can form a water lock and flush the cavitating projectile surface when the minimum gaps (δ) decrease to their critical value. When any portion of the frontal surface is flushed, the cavitating projectile loses its cavitation stability, overturns and is inhibited by the viscous resistance of the water.

While the cavitating projectile is moving in the cavity, its current velocity (V) at the underwater distance (S) does not depend on the depth, but depends on the initial velocity ($V_0$), its mass (m) and the force of cavitation drag (F):

$$V=V_0\times e^{-S\times F/m}$$

With the drop of the cavitating projectile velocity (V), the cavitation number (σ) grows and the cavity dimensions ($L_K$ and $D_K$) reduce, wherein with the depth increase the dimensions reduce earlier, at a lager velocity (V) and at a shorter distance (S). When the cavity circular collapses on the gliding surface, the cavitating projectile is flushed, inhibited by the viscous resistance of the water and quickly stops.

In accordance with hydrodynamics laws, the increase in the velocity (V) and energy (E) of the cavitating projectile on the underwater trajectory, which determine the effectiveness of hitting underwater targets, can be achieved by increasing the mass (m) of the cavitating projectile due to the maximum approximation of its outer surfaces to the cavity contour (W) formed in the water.

A cavitating projectile of an underwater ammunition designed for firing from a firearm using a discarding sabot is known (see Patent RU 2 268 455 C1, Int. C1.$^7$ F42B 10/38 of 20.01.2006 or publication international application WO 2006/057572 A1 of 01.06.2006). This cavitating projectile "analog" comprises a head portion conjugated with a secant nasal surface having a cavitating edge, a central portion and an aft portion with a gliding surface designed to stabilize the cavitating projectile in a cavity due to one-sided periodic wetting and gliding along the cavity contour (W). A cavitating projectile caliber (D) is defined by the largest diameter of the circle circumscribing the cross-section of the aft portion. In the plane of the axial longitudinal section of this cavitating projectile, an apex angle of the tangents to the secant nose surface at the points of its conjugation with the cavitating edge measured from the side of the head portion is 60°-180°. The enveloping contour (R) of the cavitating projectile cross-sections is limited by the contour of three conjugate truncated cones, wherein the diameter of the top base of the first truncated cone is equal to the diameter of the cavitating edge (d) and is 0.08-0.28D, the height of the first truncated cone is 0.4D, the conjugation diameter of the first and second truncated cones does not exceed 0.4D. The height of the second truncated cone is equal to the caliber (D), and the conjugation diameter of the second and third truncated cones does not exceed 0.6D. The stabilization of this cavitating projectile in the air can be provided by spin or by a tail fin stabilizer.

The application of the cavitating projectiles "analog" in 5.45-30 mm ammunition showed a stable cavitation movement in the water at increased initial perturbations, for example, when firing from the air into the water at angles of 5-7 degrees to the water surface.

However, the cavitating projectile enveloping contour (R) limited by the contour of three conjugated truncated cones cannot accurately approach the cavity contour (W) formed in the water; therefore, this cavitating projectile "analog" has an underestimated mass and an underestimated effectiveness of hitting underwater targets.

The closest analog (prototype) to the claimed invention is a cavitating projectile designed for firing from a firearm or shooting from a throwing weapon, which is stabilized in the air by spin or by a tail fin stabilizer (see Patent RU 2 316 718 C1, Int. C1.[7] F42B 10/42 of 10.02.2008; the U.S. Pat. No. 8,082,851 B2, Int. C1.[7]F42B 12/74 of 27.12.2011 and European Patent Specification No. EP 2 053 342 B1, Int. C1.[7]F42B 10/42 of 18.06.2014). This cavitating projectile "prototype" comprises a head portion conjugated with a secant nose surface having a cavitating edge, a central portion and an aft portion with a gliding surface designed to stabilize the cavitating projectile in a cavity due to one-sided periodic wetting and gliding along a contour (W) of the cavity. A cavitating projectile caliber (D) is defined by a largest diameter of a circle circumscribing a cross-section of the aft portion. In a plane of a cavitating projectile axial longitudinal section, a current diameter ($D_X$) of an enveloping contour line (R) from the cavitating edge to the cavitating core caliber (D) is limited by the equation:

$$D_X=d\times[1+(L_X/d)\times(2\times\sin\varphi/\pi)^{1/N}]^N,\text{ wherein:}$$

$D_X$—is a current diameter of the enveloping contour line (R) on a current length ($L_X$) from the cavitating edge to the cavitating core caliber (D), in millimeters;

d—is a diameter of the cavitating edge, in millimeters;

$L_X$—is the current length from the cavitating edge to the cavitating core caliber (D), in millimeters;

φ—is an apex angle, in a range of 60° to 270°, of tangents to the secant nose surface at points of conjugation of the secant nose surface with the cavitating edge measured from a side of the head portion;

N—is a cavitating projectile volume factor in a range of $(2\pi/\varphi)^{0.4}$ to $(2\pi/\varphi)^{0.2}$;

wherein the cavitating core caliber (D) is equal to the current diameter ($D_X$) of the enveloping contour line (R).

In this equation, the cavitation drag index ($c_X$) of the nose surface is expressed through the angle (φ) by the function $c_X=\sin\varphi/\pi$ and differs by 2% to 7% from the theoretical index ($c_X$) that is indicated in the book of GUREVICH M. I. "Teoria struy idealnoy zhidkosti"—Moscow, Physical-mathematical Literature Publishing, 1961, page 443.

The application of the cavitating projectiles "prototype" in 4.5-18.5 mm ammunition showed a stable cavitation movement in the water at increased disturbances, for example, after piercing through two underwater aluminum targets 2 mm thick.

However, the application of cavitating projectiles "prototype" and "analog" when hunting in the air and under the water showed that they form a straight-through wound channel in the soft muscle tissues of the hunting object and have a low stopping power when the hunting object is injured in its non-vital organs. At the same time, the soft muscle tissues around the through rectilinear wound channel turns into a mucous mass due to the hydraulic effect from the formed cavity and are not suitable for cooking. These soft muscle tissues damaged and not suitable for cooking can make up to 10-30% of the total weight of the hunting object especially when using recoilless underwater firearms and a cavitating projectile with the cavitating edge diameter d>2.5 mm.

Analysis of the equation of the enveloping contour (R) of the cavitating projectile "prototype" shows that at the angles φ=60° . . . 180° and d<2.5 mm, between the enveloping contour (R) and the cavity contour (W) the minimum design gaps δ=0.5-0.7 mm at the length $L_X$=0.3-0.9D are formed. When d>2.5 mm, the minimum design gaps (δ) grow: at d=3.2 mm they are δ=0.7-0.9 mm on the length $L_X$=0.3-0.9D and continue to grow with a further increase in the diameter (d) of the cavitating edge. It was experimentally determined that such minimum design gaps (δ) provide a stable cavitation movement of the cavitating projectile not only in water, but also in other inhomogeneous (heterogeneous) aqueous-containing.

Increased cavitation stability of the cavitating projectile is necessary in water, but not desirable in any other inhomogeneous (heterogeneous) aqueous-containing medium, because the effectiveness of its use decreases due to a low stopping power and high degree of damage to the soft tissues of the hunting objects, which is unacceptable when hunting large fish: tuna, swordfish, blue marlin, etc.

SUMMARY OF THE INVENTION

The objective of the given invention is improvement of the cavitating projectile efficiency through bringing the contour of its outer surfaces closer to the cavity contour (W) formed in water, increasing its mass, and enhancing its stopping power due to the loss of cavitation stability and overturn in the inhomogeneous (heterogeneous) and compressible aqueous-containing medium of a target with the increase of the contact area with the target.

The achievement of the mentioned objective is provided by a cavitating projectile of firearm ammunition comprising: a head portion conjugated with a secant nose surface having a cavitating edge, a central portion, and an aft portion with a gliding surface configured to stabilize the cavitating projectile in a cavity due to one-sided periodic wetting and gliding along a contour (W) of the cavity, wherein a caliber (D) of the cavitating projectile is defined by a maximum diameter of a circle circumscribing a cross-section of the gliding surface, where, pursuant to this invention, in a plane of an axial longitudinal section of the cavitating projectile, a diameter ($D_X$) of an enveloping contour line (R) extending from the cavitating edge to the cross-section of the gliding surface is limited by the equation:

$$D_X=d\times[1+(L_X/d)\times2\pi\times\sin\varphi/\pi]^N,\text{ wherein:}$$

$D_X$—is the diameter of the enveloping contour line (R) at a length ($L_X$) from the cavitating edge, in millimeters;

d—is a diameter of the cavitating edge, in millimeters;

$L_X$—is the length from the cavitating edge, in millimeters;

Φ—is an apex angle, in a range of 60° to 180°, of tangents to the secant nose surface at points of conjugation of the secant nose surface with the cavitating edge measured from a side of the head portion; and N—is a cavitating projectile volume factor in a range of 0.25 to 0.40;

wherein the caliber (D) of cavitating projectile is equal to the diameter ($D_X$) of the enveloping contour line (R) when $L_X$=L, where (L) is a length from the cavitating edge to a leading edge of the gliding surface, and a center of mass of the projectile is located at a length (X) in front of the leading edge of the gliding surface, where X≥0.3D.

That stated totality of inventive features specified in the independent patent claim exceeds the enveloping contour (R) of the "prototype" and brings the enveloping contour (R) of the claimed cavitating core closer to the cavity contour (W) formed in the water with the decrease of the gaps (δ) between them.

These differences from the "prototype", all other things being equal, increase the volume and mass of the head portion of the cavitating projectile, shift its center of mass to the head, ensure its stable cavitation movement in water with reduced gaps (δ), but leads to the loss of its cavitation stability and overturn in a heterogeneous aqueous-containing medium (in the body of a hunting object) in the following way:

in a heterogeneous and compressible aqueous-containing medium, the depth of the gliding surface wetting is increased beyond the cavity contour (W) formed in this medium, the amplitude of angular oscillations of the cavitating projectile increases, that leads to the decrease of the minimum allowable gaps (δ) between the outer surface of the cavitating projectile and the cavity contour (W) formed in this medium;

particles of water (water vapor), as well as other particles of this medium, breaking away from the cavitating edge, get stuck in the reduced minimum allowable gaps (δ) and flush the outer surface of the cavitating projectile;

flushing of the frontal surface of the cavitating projectile in front of its center of mass leads to the loss of cavitation stability, overturn, an increase in the contact area with the object of hunting and sharp braking with the transfer of all energy to the hunting object, which increases its stopping power in comparison with the prototype and excludes the formation of a through wound with the damage to soft tissues of hunting objects.

To fulfill the conditions of this invention, the geometry of the cavitating projectile should be matched to the cavity contour (W) formed in the water so that when the cavitating projectile is gliding in the cavity, the minimum permissible gaps (δ) between its frontal surface and the cavity contour (W) are provided that are decreasing to the gliding surface.

To meet these requirements, the current diameters ($D_X$) of cross-sections of the cavitating projectile from the cavitating edge to its caliber (D) should not exceed the enveloping contour (R), and the caliber (D) of the projectile should be equal to the current diameter ($D_X$) of the enveloping contour (R) at $L_X$=L, where (L) is the length from the cavitating edge to the cavitating core caliber (D). Exceeding the enveloping contour (R) leads to the decrease of the minimum permissible gaps (δ), flushing of the part of the cavitating projectile frontal surface protruding beyond the enveloping contour (R), and the loss of its cavitation stability in the water. The underestimation of the enveloping contour (R) leads to the decrease of the cavitating projectile mass, but can be compensated through the increased length. Optimally, the outer surface of the cavitating projectile should coincide with the enveloping contour (R), and the structural elements of the cavitating projectile, for example, threads, circular grooves or longitudinal slots may be lower relative to the enveloping contour (R). The center of mass of the cavitating projectile should be located at the length X≥0.3D in front of the leading edge of the gliding surface located at the length (L), and a decrease in size (X) leads to a change in the trajectory of movement in the water and in other aqueous-containing media.

The cavity contour (W) formed in the water and the enveloping contour (R) of the cavitating projectile depend on the cavitating edge diameter (d) and the cavitating drag index ($c_X$), which depends on the geometry of the nose surface ($c_X$=sin φ/π). For the selected dimensions (d) and (φ), the cavitating projectile can have a volume factor N=0.25 . . . 0.40. When the volume factor N>0.40 is overestimated, the enveloping contour (R) of the cavitating projectile gets closer to the cavity contour (W) formed in the water beyond the permissible gaps (δ), which leads to the loss of the cavitation stability of the cavitating projectile in the water. With the underestimation of the volume coefficient N<0.25, the mass and efficiency of the cavitating projectile decrease due to the increase in the gaps (δ) between the surfaces of the cavitating projectile and the cavity contour (W) formed in the water, which eliminates losing of its cavitation stability in a heterogeneous aqueous-containing medium.

The apex angle (φ) of the tangents to the secant nose surface at the points of its conjugation with the cavitating edge measured from the side of the head portion is selected considering the dimensions, mass, muzzle velocity and material of the cavitating projectile. For example, at a high muzzle velocity and mass of the cavitating projectile, and in case the nose surface is made from an easily deformable material (non-ferrous alloy or low-carbon steel), it is advisable to use φ<150°, thus avoiding deformation of the nose surface by the oncoming water flow. With a small diameter of the cavitating edge (d<1.2 mm at φ=180°), when unstable formation of a cavity in the water is possible at low Reynolds numbers, it is advisable to use φ<120°, which makes it possible to increase d>1.2 mm while maintaining the contour of the cavity (W) formed in the water.

The nose surface of the cavitating projectile can be made in the form of a flat face, a cone, a cone with a rounded top, a truncated cone, or a truncated cone with a rounded edge of a smaller base. In this case, the diameter of the smaller base of the truncated cone, considering the rounded edge, or the diameter of the base of the spherical segment in the cone with the rounded top, should not exceed 0.5d for the correct formation of the cavity. The nose surface in the form of a flat face is the easiest to manufacture. A blunt or rounded nose surface reduces aerodynamic and cavitation drag due to the decrease in the length and surface friction area of the nose surface at the angles φ<140°.

In the head portion of the cavitating projectile a narrow circular groove may be made, a minimum diameter of which is 1.3-to 1.8 times of the cavitating edge diameter (d). The narrow circular groove allows the cavitating projectile to enter the water when firing at a small angle to the water surface by creating a temporary cavity by means of its edge, which is formed at the conjugation of the rear wall of the circular groove with the outer surface of the head portion of the cavitating projectile. If the head portion of the cavitating projectile is made of easily deformable material (non-ferrous alloy or low-carbon steel), the nose of the head portion bends along the minimum diameter of the narrow circular groove when hitting a hard obstacle, for example, when hitting a bone tissue of the hunting object. This accelerates the loss of stability of the curved cavitating projectile in the soft tissues of the hunting object. If the head portion of the cavitating projectile is made of high-strength material (hardened steel or tungsten alloy), the nose of the head portion breaks off along the minimum diameter of the circular groove when hitting a hard target that is located at a small angle to the firing line. And the rear wall of the circular groove, diameter of which is larger than the cavitating edge diameter (d), interacts with the target that excludes the cavitating projectile ricochet. When the minimum diameter of the circular groove is less than 1.3d, the head portion of the cavitating projectile may curve when it enters the water, and when the minimum diameter of the circular groove is more than 1.8d, the head portion of the cavitating projectile may not deform when it hits a hard target.

The aft portion of the cavitating projectile may be made in the form of a multi-blade tail fin stabilizer and can be installed with the possibility of rotation around the longitudinal axis of the cavitating projectile and can be equipped with a cylindrical tail section. The possibility of rotation of the fin-stabilizer around the longitudinal axis prevents its joint rotation with the head and central portions when fired from a rifled barrel, which reduces dispersion of cavitating projectiles in the air and in the water. The equipping of the fin stabilizer with a cylindrical tail section increases aerodynamic stability in the air and makes it possible to fasten the cavitating projectile in a cartridge case of some ammunition designs.

The head and central portions of the cavitating projectile may be equipped with a protective cap that breaks down when fired. This provides protection of the nose surface with a cavitating edge from mechanical deformations during transportation, ammunition assembly and when using ammunition in weapons, more reliable ammunition sealing.

Cavitating projectile up to five calibers (D) long with or without a discarding sabot can be stabilized in the air by spin, and longer than four calibers (D) can be stabilized in the air by aerodynamic drag of the aft portion made in the form of a tail fin stabilizer. At the same time, the tail fin stabilizer may be installed with the possibility of separating from the cavitating projectile in the water, which makes it possible to use cavitating projectiles with increased mass and better hydrodynamic parameters, and also allows increasing the maximum range of underwater firing at a greater depth. Moreover, the cavitating projectile with a discarding sabot may be stabilized in the air by the aerodynamic drag of the sabot, which has technical feasibility to discard from the cavitating projectile only in the water. This makes it possible to use a cavitating projectile without a tail fin stabilizer, which has increased mass and better hydrodynamic parameters, for firing from the air into the water from a smooth or rifled barrel.

The specified set of features of this invention allows us to increase the efficiency of the cavitating projectile by bringing the enveloping contour (R) of its outer surfaces closer to the cavity contour (W), the increase of its mass and its stopping power due the cavitation stability loss with overturning in a heterogeneous and compressible aqueous-containing medium of the soft tissues of the hunting object.

It should be noted that for a person skilled in the art of ammunition it would be obvious to increase the stopping power of the cavitating projectile by making various grooves in it, as it is done in the designs of the well-known expanding bullets, which increase their diameter when penetrating into soft tissues of the hunting object. At the same time, it would also be obvious for a person skilled in this art not to exceed the enveloping contour (R) of the analogue or prototype of this invention, which guarantees stable movement of the cavitating projectile in the contour cavity (W) formed in the water. However, the expanding effect of the well-known expanding bullets that are intended for firing in the air is provided by their transition from the air into a denser medium.

BRIEF DESCRIPTION OF THE DRAWINGS

The invention is explained in more detail with the reference to specific embodiments that in no way reduce the volume of claims and are only intended for better understanding of the invention by one of skill in the art. In the description of specific embodiments of the invention there are references to the accompanying drawings that show the following:

DETAILED DESCRIPTION

Cavitating projectiles of firearm ammunition according to the invention can be used for underwater hunting and for protection against attacks by predators in the water when firing from existing and perspective small arms and hunting guns, as well as when using the device for underwater firing from small arms according patent RU 2 733 018 C1 of 28.09.2020 and publication of international application WO 2021/167489 A1 of 26.08.2021. Ammunition with a cavitating projectile can be included in the allowance of ammunition of combat swimmers, marines, coast guards, ship staff and naval aviation crews.

Ammunition with a cavitating projectile can be used to defend sea and coastal objects from attacks by underwater, surface and air attack weapons when firing from existing and prospective machine guns and cannon armaments of aviation, ships and submarines, as well as when using the device for underwater firing from a firearm according patents RU 2 498 189 C2 of 10.11.2013 and U.S. Pat. No. 8,919,020 B2 of 30.12.2014 and EP 2 690 390 B1 of 10.08.2016, as well as when using the recoilless underwater firearm according patents RU 2 651 318 C2 of 19.04.2018 and U.S. Pat. No. 10,591,232 B2 of 17.03.2020 and EP 3 431 915 B1 of 20.10.2021.

The invention can be used in designs of jet weapons intended for flight in the air and/or cavitation movement in the water.

Figure 1:
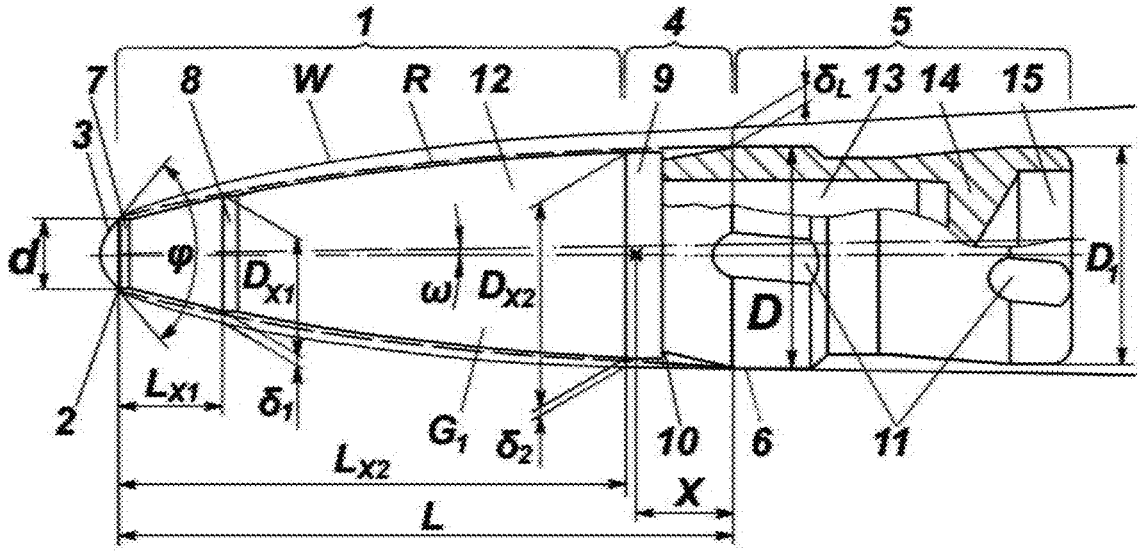
FIG. 1 shows the first example of the invention embodiment in a cavitating projectile of .223 (5.56×45 mm) ammunition during its movement in a cavity formed in the water.

FIG. 1 shows a schematic view of a cavitating projectile ($G_1$) of .223 (5.56×45 mm) ammunition after a shot from a rifled barrel and gliding along a cavity contour (W) formed in the water. The cavitating projectile ($G_1$) includes: a head portion 1 conjugated along a cavitating edge 2 with a diameter (d) with a secant nose surface 3, made in the form of a cone with a rounded top, where an apex angle of the tangents to the secant nose surface 3 at the points of its conjugation with the cavitating edge 2 is $\varphi=90°$, a central portion 4 and an aft portion 5 with a gliding surface 6.

In the plane of the axial longitudinal section of the cavitating projectile ($G_1$), the current diameter ($D_X$) of the enveloping contour line (R) of its cross-sections from the cavitating edge 2 to the leading edge of the gliding surface 6, located at the length (L), the diameter of which is equal to the cavitating projectile caliber (D), is limited by the equation:

$$D_X=d\times[1+(L_X/d)\times 2\pi\times\sin\varphi/\pi]^N, \text{ wherein:}$$

d=2.1 mm: $\varphi=90°$; $\pi=3.14$: N=0.3157 and $D=D_X=5.68$ mm when $L_X=L=15.6$ mm, where (L) is the length from the cavitating edge 2 to the cavitating projectile caliber (D).

The rounding of the top of the nose surface 3 is made in the form of a spherical segment with the base diameter of 0.4d for the correct formation of the cavity contour (W). The cavitating edge 2 has a cylindrical section 7, and the leading edges of the cylindrical sections 8 and 9 may coincide with the current diameters ($D_{X1}$) and ($D_{X2}$) of the enveloping contour line (R) at the current lengths $L_{X1}=3.0$ mm and $L_{X2}=12.5$ mm. These cylindrical sections 7, 8 and 9 allow precise control of the manufacture of their dimensions, which determine the operability of the cavitating projectile. Other outer surfaces of the head portion 1 and the central portion 4 are limited (slightly less) by the enveloping contour line (R), which simplifies their manufacture and control. The cylindrical sections 8 and 9, as well as the tapered circular groove 10 are intended for fastening a protective cap shown in FIG. 2 ((R) and (W) contours shown in FIG. 1).

The cavitating projectile ($G_1$) contains a slug 12 pressed with its cylindrical portion 13 into a jacket 14. The mass of the cavitating projectile ($G_1$) is 5.4 g when the slug 12 and its cylindrical portion 13 are made of high-density and high-strength material, namely, tungsten alloy with the density $\rho=17.0$ g/cm$^3$ and the jacket 14 is made of easily deformable non-ferrous alloy, namely, of brass with the density $\rho=8.4$ g/cm$^3$. The base pocket 15 in the jacket 14 shifts the center of mass of the cavitating projectile ($G_1$) to the head by the length X=0.38D from the leading edge of the gliding surface 6 located at the length (L), that complies with the conditions of this invention ($X\geq 0.3D$) and provides rectilinear cavitation movement in the water. Herewith, the dimensions of the cylindrical portion 13 of the slug 12 and the sizes of the base pocket 15 provide the possibility of varying the location of the center of mass.

Figure 2:
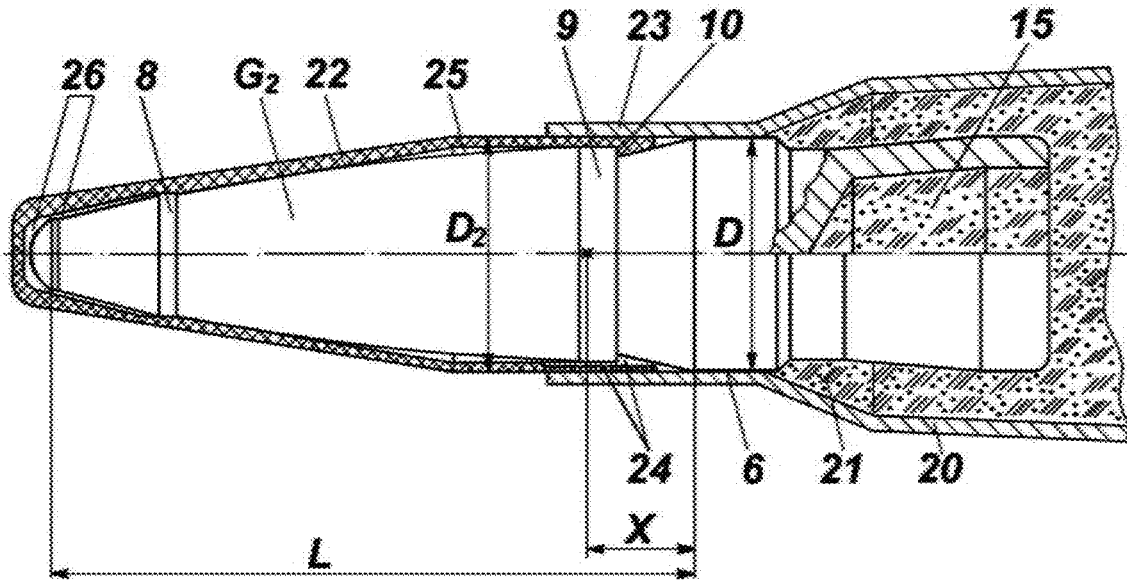
FIG. 2 shows the second example of the invention embodiment in a cavitating projectile, which is fastened in .223 (5.56×45 mm) ammunition.

The length of the cavitating projectile ($G_1$) equals to 4.6D and its stabilization in the air is provided by spin when fired from a standard 5.56 mm rifled barrel with the twist rate of 7" (178 mm), and at a shot the rifling grooves 11 from the rifled barrel are formed on the outer surfaces of (D) and ($D_1$) diameters. In the water, the cavitating projectile ($G_1$) touches the cavity contour (W) by its gliding surface 6 with the rifling grooves 11, and the diameter ($D_1$) does not touch the cavity contour (W). At the same time, the diameter ($D_1$) can be less than the cavitating projectile caliber (D), for example, $D_1=0.995D$ for better fastening of the cavitating projectile in the neck of the cartridge case, as it is shown in FIG. 2 ((R) and (W) contours shown in FIG. 1). Besides, the diameter ($D_1$) can be equal to the cavitating projectile caliber (D), for example, $D_1=D$ to simplify the cavitating core manufacturing technology. Moreover, the diameter ($D_1$) may exceed the cavitating projectile caliber (D), for example, $D_1=1.01D$ when using the cavitating projectile design ($G_1$) in ammunition of a recoilless firearm shown in FIG. 6.

During the movement in the cavity formed in the water and gliding the surface 6 along the cavity contour (W), the maximum inclination angle ($\omega$) of the cavitating projectile ($G_1$) in the cavity is $\omega=4.00$ with the maximal design gap $\delta_L=2.18$ mm at the length L=15.6 mm. At the same time, the minimum design gaps $\delta_1=0.35$ mm and $\delta_2=0.09$ mm are formed between the cavity contour (W) and the leading edges of the cylindrical sections 8 and 9 at the lengths $L_{X1}=3.0$ mm and $L_{X2}=12.5$ mm, respectively.

During the movement in heterogeneous and compressible aqueous-containing medium, the depth of wetting of the gliding surface 6 beyond the cavity contour (W) increases and the inclination angle ($\omega$) of the cavitating projectile ($G_1$) increases as well. This leads to the disappearance of the gap ($\delta_2$) and flushing of the surface of the cylindrical section 9 in the zone of the center of gravity of the cavitating projectile, which causes a change in its trajectory. At the same time, a decrease in the gap ($\delta_1$) and flushing of the surface 8 by the aqueous-containing medium particles makes the cavitating projectile ($G_1$) lose its cavitation stability, overturn, an increase in the contact area with the object of the hunt and sharp braking with the transfer of all energy to the hunted object, which significantly increases its stopping power in comparison with the cavitating projectiles "prototype" and "analog".

FIG. 2 shows a schematic view of a fragment of .223 (5.56×45 mm) ammunition with a fastened cavitating projectile ($G_2$). The ammunition includes: a brass cartridge case 22 with a primer and a propellant charge 21, in the neck of which the cavitating projectile ($G_2$) with a protective cap 22 is fastened. The dimensions and designation of the outer surfaces of the cavitating projectile ($G_2$) are equal to the dimensions of the cavitating projectile ($G_1$). The mass of the cavitating projectile ($G_2$) is 3.1 g when it is made of easily deformable non-ferrous alloy, namely, of bronze with the density $\rho=8.8$ g/cm$^3$. The base pocket 15 allows to place a part of the propellant charge 21 in it and shifts the center of mass of the cavitating projectile to the head by the length X=0.35D from the leading edge of the gliding surface 6 located at the length (L). That meets the terms of this invention ($X\geq 0.3D$) and provides rectilinear cavitation movement in the water.

A protective cap 22 is pressed onto the cylindrical sections 8 and 9 and fixed in a conical circular groove 10. The protective cap 22 has a mass of 0.12 g when made of plastic of a PA-6 type with the density $\rho=1.12 \ldots 1.15$ g/cm$^3$ and tensile strength Rm=65 . . . 70 MPa and is designed to protect the nose surface 3 with the cavitating edge 2 from damage during transportation, ammunition assembling and using ammunition in weapons, as well as to ensure better ammunition sealing. The diameter $D_2=1.005D$ ensures a tighter fixation of the plastic cap 22 in the neck 23 of the cartridge case 20. The length of .223 (5.56×45 mm) ammunition with the cavitating projectile of the given invention is equal to the length of standard .223 (5.56×45 mm) ammunition for a possibility of using it in the existing firearms.

During a shot and accelerating the cavitating projectile ($G_2$) or ($G_1$) with the plastic cap 22 in the barrel bore, a propellant gas flows through a narrow longitudinal groove 24 and fills cavities 25 and 26 between the inner surface of the plastic cap and the outer surface of the head part of the cavitating projectile. The plastic cap 22 discards in the middle part or in muzzle part of the barrel bore from the pressure of the propellant gas accumulated in the cavities 25 and 26, and the cavitating projectile moving at this moment in the rifled barrel does not receive any initial disturbances from the discarding of the plastic cap.

Similarly, the plastic cap 22 discards from the cavitating projectile at underwater firing from a wet firearm, which is accompanied by the expulsion of the water by the propellant gas from the barrel. Moreover, for underwater firing, specially loaded universal ammunition with a reduced mass of the propellant charge is used, which provides an allowable pressure during an underwater shot accompanied by pushing water out of the barrel. At the same time, the operability of standard assault rifles "HK 416", "HK SL8". "LMT-Piston", "Galil ACE" and "FN SCAR-L" was experimentally determined during automatic underwater firing with universal .223 (5.56×45 mm) ammunition with cavitating projectile of the given invention and with cavitating cores "prototype".

The cavitating projectile ($G_2$) has a lower mass and effective underwater firing range than the cavitating projectile ($G_1$), but it can be used for sports firing in "Aqua Shooting Range" according patents RU 2 316 712 C2 of 10 Feb. 2008 and U.S. Pat. No. 7,942,420 B2 of 17 May 2011 and EP 1 884 736 B1 of 29 May 2013. At the same time, the cavitating projectile ($G_2$) loses its cavitation stability and overturns when penetrating into a block of ballistic gelatin, similar to the cavitating projectile ($G_1$). When firing from the air into the water with a muzzle velocity of $V_0$=950 m/s, and when underwater firing from wet firearm with a muzzle velocity of $V_0$=710 m/s, the cavitating projectile ($G_2$) has a velocity of V=220 m/s and energy of E=75 Jules at an underwater range S=5 m and S=4 m, respectively. Therefore, .223 (5.56×45 mm) ammunition with the cavitating projectile ($G_2$) may be used to hunt fish weighing up to 40 kg up to S=4 . . . 5 m underwater range.

When firing in the air with a muzzle velocity $V_0$=950 m/s, the cavitating projectile ($G_2$) has a velocity and energy: $V_{100}$=800 m/s and $E_{100}$=90 Jules. $V_{200}$=680 m/s and $E_{200}$=720 Jules, at 100 m and 200 m range, respectively. Improvement of ballistic parameters can be provided by reducing the diameter (d) of the cavitating edge 2 and the area ($S_N$) of the nose surface 3 with an increase in the angle (+) to maintain the parameter ($c_X$×d) and the cavity contour (W) ((R) and (W) contours shown in FIG. 1). For example, the cavitating projectiles ($G_1$) and ($G_2$) have the area of the nose surface 3, taking into account the rounded top, is $S_N$=4.60 mm$^2$ at φ=900 and d=2.1 mm, and at dimensions of φ=180° and d=1.7 mm, the area of the nose surface will decrease by 100% ($S_N$=2.27 mm$^2$), while the parameter ($c_X$×d) and the cavity contour (W) will not change, but the wave resistance of the nose surface in the air will decrease.

The cavitating projectile ($G_2$) can be made of an easily deformable material with strength parameters equivalent to low carbon steel or non-ferrous alloys such as copper, tombac or brass, and filled with a high-density material with density parameters equivalent to tungsten or lead based alloys. The mass of the cavitating projectile ($G_2$) can be increased to 3.6 g by making the base pocket 15 to the cylindrical section 8 and filling this volume with lead with the density ρ=11.3 g/cm$^3$ while maintaining the unfilled part of the base pocket 15 to ensure the center of mass along the length X≥0.3D from the leading edge of the gliding surface 6. This will improve the ballistic and hydrodynamic parameters of the cavitating projectile ($G_2$) by increasing its mass. Moreover, in the part of the base pocket 15 not filled with lead, a tracer with the density ρ=1.6 . . . 1.8 g/cm$^3$ can be installed, which can increase the effectiveness of firing in the water and in the air at a moving target.

Comparison of the enveloping contour (R) of the cavitating projectile ($G_1$ or $G_2$) of this invention and it "analog" shows that the enveloping contour (R) of the "analog" is limited by the diameter 0.4D=2.27 mm at the length of 0.4D. But, in the cavitating projectile ($G_1$ or $G_2$) at the length $L_X$=0.4D, the enveloping contour (R) is limited by the diameter $D_X$=3.05 mm, and is 34% bigger than the diameter of the enveloping contour (R) of the "analog". This shows that the enveloping contour (R) of the given invention is closer to the cavity contour (W) than the enveloping contour (R) of the "analog".

Comparative calculation of the enveloping contour (R) of the cavitating projectile ($G_1$) or ($G_2$) using the "prototype" equation:

$$D_X=d\times[1+(L_X/d)\times(2\sin\varphi/\pi)^{1/N}]^N$$

shows that at the sizes: d=2.10 mm, φ=900 and N=0.484 between the cavity contour (W) and caliber D=5.68 mm of the cavitating projectile "prototype", the design gap $\delta_L$=2.18 mm and the maximum inclination angle ω=4.00 at the length L=15.6 mm are formed. And the minimum design gaps are $\delta_1$=0.65 mm and $\delta_2$=0.15 mm that can be formed between the enveloping contour (R) and the cavity contour (W) at the lengths $L_{X1}$=3.0 mm and $L_{X2}$=12.5 mm, respectively. This calculation shows that in the cavitating projectile "prototype" the gaps ($\delta_1$) and ($\delta_2$) are 60% larger than the gaps ($\delta_1$) and ($\delta_2$) in the given invention. This provides stable cavitation movement of the cavitating projectile "prototype" in the cavity formed in the water and in a heterogeneous and compressible aqueous-containing medium.

Comparative firing with .223 (5.56×45 mm) ammunition with the cavitating projectile ($G_1$) of the given invention with the mass of 5.4 g and with cavitating projectile "prototype" with the mass of 5.2 g into aqueous-containing targets at impact velocities in the interval from 250 m/s to 750 m/s confirmed differences in their stopping power features.

Figure 3:
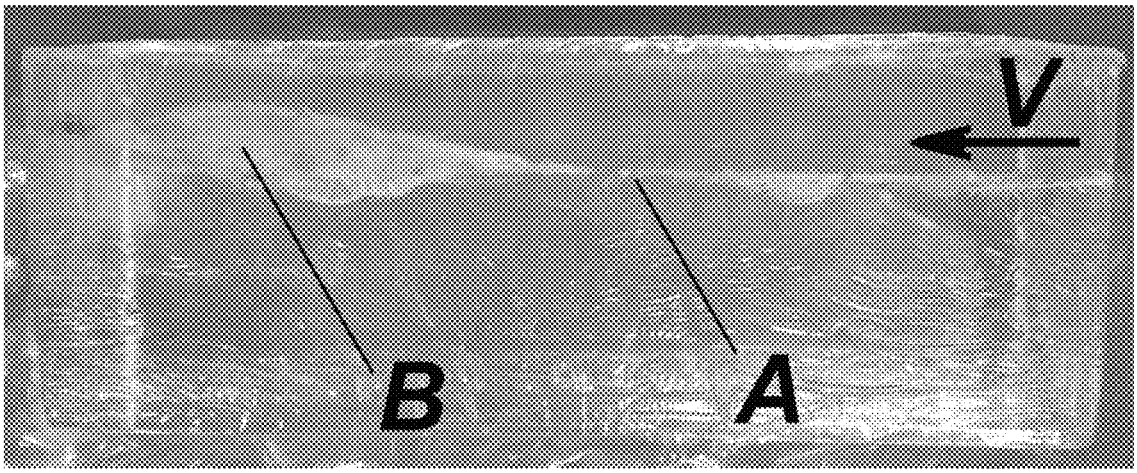
FIG. 3 shows the photo of a block of ballistic gelatin with a shot hole from the cavitating projectile of the given invention that is shown in FIG. 1.
Figure 4:
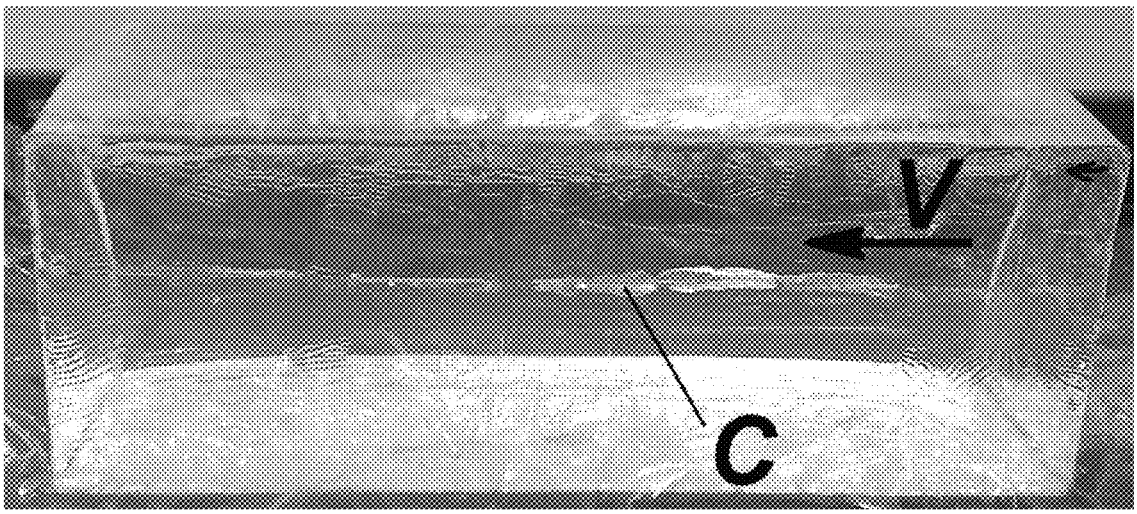
FIG. 4 shows the photo of a block of ballistic gelatin with a shot hole from the cavitating projectile "prototype" of .223 (5.56×45 mm) ammunition.

Firing into ballistic gelatin blocks with sizes of 200×200×500 mm, containing about 80-90% of the water showed the following:

- the cavitating projectile ($G_1$) of the given invention forms a curved hole with a volumetric cavity from its overturning due to losing of cavitation stability and is stopped in the ballistic gelatin block at a length of 0.35-0.45 m, as shown in FIG. 3;
- the cavitating projectile "prototype" pierces two ballistic gelatin blocks with a total length of one meter and continues its flight, and a through hole with a diameter of 8-10 mm is formed in the ballistic gelatin blocks, as shown in FIG. 4.

FIG. 3 shows the photo of a ballistic gelatin block with sizes of 200×200×500 mm with the curved hole (A) and the volumetric cavity (B) after firing with .223 (5.56×45 mm) ammunition with the cavitating projectile ($G_1$) with the mass of 5.4 g at the impact velocity of V=518 m/s, where the arrow (V) indicates the direction of movement of the cavitating projectile.

FIG. 4 shows the photo of a ballistic gelatin block with sizes of 200×200×500 mm with the through hole with a diameter of 8-10 mm (C) after a shot with .223 (5.56×45 mm) ammunition with the cavitating projectile "prototype" with the mass of 5.2 g at the impact velocity of V=526 m/s, where the arrow (V) indicates the direction of movement of the cavitating projectile, while the asymmetry of the through-hole channel (C) shows a heterogeneous composition of the ballistic gelatin.

Firing into ripe watermelons containing 80-90% of water showed the following:

- the cavitating projectile ($G_1$) of the given invention loses cavitation stability and overturns in the pulp of the watermelon and breaks the watermelon at many fragments, while the pulp of the watermelon in these fragments retains its taste and is suitable for eating;
- the cavitating projectile "prototype" makes a through hole in the watermelon and continues its flight without loss of cavitation stability, while all the watermelon pulp turns into a mucous mass due the hydraulic effect from the formed cavity and is not suitable for eating.

These examples show that the given invention increases the efficiency of the cavitating projectile by providing a possibility of losing its cavitation stability in an inhomogeneous (heterogeneous) and compressible aqueous-containing medium.

Figure 5:
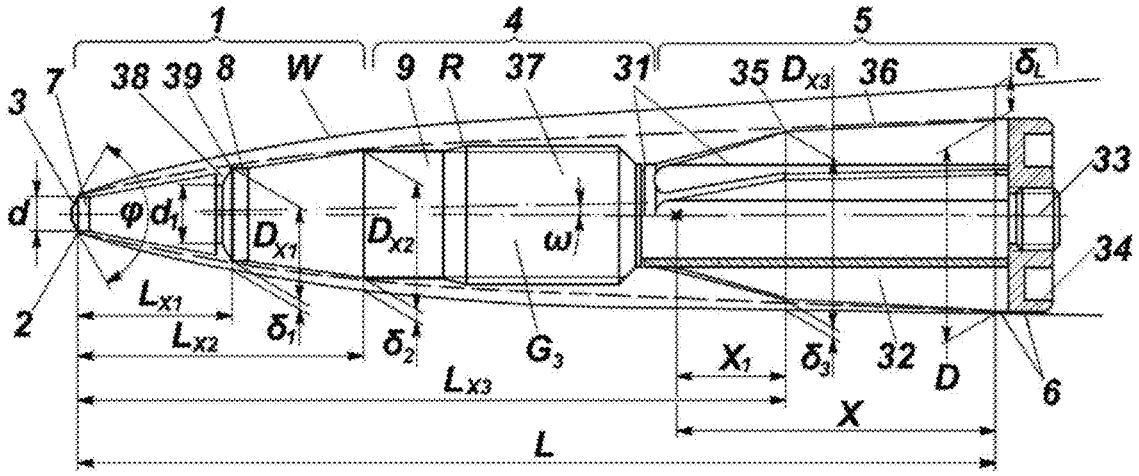
FIG. 5 shows the third example of the invention embodiment in a cavitating projectile of 12th gauge shotgun ammunition during its movement in a cavity formed in the water; and, FIG. 6 shows the fourth example of the invention embodiment in a cavitating projectile, which is fastened in 12th gauge shotgun ammunition (12/70).

An example of increased cavitation stability of a cavitating projectile "prototype" with the mass of 15.9 g for .308 (7.62×51 mm) ammunition, which at subsonic impact velocity about 315 m/s, does not change its trajectory at walls piercing with cavity formation in nine plastic containers filled with water and pierces a 5 mm steel plate, is shown on the website: www.youtube.com/watch?v=IdOOKQL0_WE www.guns.com/news/2012/08/28/pnw-arms-supercavitating-underwater-ammo Another example of increased cavitation stability of a cavitating projectile "prototype" with the mass of 15.9 g for .308 (7.62×51 mm) ammunition, which at impact velocity about 550 m/s penetrates with cavity formation into a ballistic gel (gelatin blocks) four meters long and a watermelon without any deformation of these targets is shown on the websites: https://www.youtube.com/watch?v=U2zfy75-f_k World Record Ballistic Gel Penetration—YouTube FIG. 5 shows a schematic view of a cavitating projectile ($G_3$) of 12th gauge shotgun ammunition (12/70) after a shot and gliding along the cavity contour (W) formed in the water. The cavitating projectile ($G_3$) includes: a head portion 1 conjugated along a cavitating edge 2 with a diameter (d) with a secant nose surface 3, made in the form of a truncated cone, where an apex angle of the tangents to the secant nose surface 3 at the points of its conjugation with the cavitating edge 2 is φ=120°, a central portion 4 and an aft portion 5 with a gliding surface 6. The aft portion 5 is made in the form of a bushing 31 with a six-blade tail fin stabilizer 32 with the gliding surface 6 mounted for free rotation on a threaded pin 33 and fixed by a disk 34, which has the form of a cylindrical tail section with a gliding surface 6.

In the plane of the axial longitudinal section of the cavitating projectile ($G_3$), a current diameter ($D_X$) of the enveloping contour line (R) of its cross-sections from the cavitating edge 2 to the leading edge of the gliding surface 6 located at the length (L), the diameter of which is equal to the cavitating projectile caliber (D), is limited by the equation:

$$D_X = d \times [1 + (L_X/d) \times 2\pi \times \sin \varphi/\pi]^N, \text{ wherein:}$$

d=3.15 mm: φ=120°; π=3.14: N=0.3847 and $D=D_X=18.5$ mm when $L_X=L=80$ mm, where (L) is the length from the cavitating edge 2 to the cavitating core caliber (D).

The diameter of the smaller base of the truncated cone of the nose surface 3 is 0.4d for the correct formation of the cavity contour (W). The cavitating edge 2 has a cylindrical section 7, and the leading edges of the cylindrical sections 8, 9 and the leading edge 35 of the tail fin stabilizer 32 may coincide with the current diameters ($D_{X1}$, $D_{X2}$ and $D_{X3}$) of the enveloping contour line (R) at the current lengths $L_{X1}=6$ mm, $L_{X2}=16$ mm and $L_{X3}=60$ mm. These cylindrical sections 7, 8 and 9 allow precise control of the manufacture of their dimensions, which determine the operability of the cavitating projectile.

Figure 6:
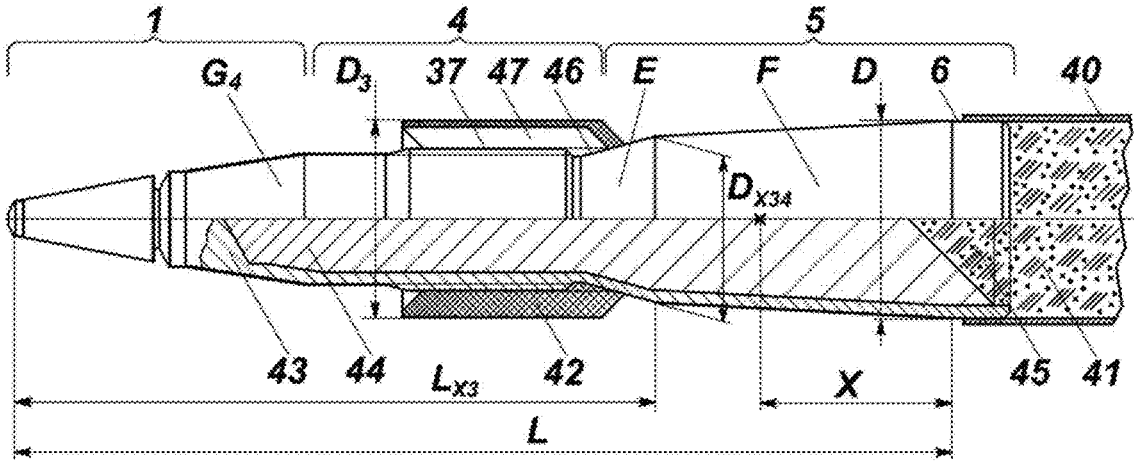

Other outer surfaces of the head portion 1 are limited (slightly less) by the enveloping contour line (R), which simplifies their manufacture and control. The outer surface 36 of the blades of the tail fin stabilizer 32 from the leading edge 35 to the cavitating projectile caliber (D) is made in the form of a truncated cone, the bases of which coincide with the diameters ($D_{X3}$ and D) of the enveloping contour line (R) at the lengths ($L_{X3}$ and L). In the central portion 4, a thread 37 (M12×1.5) is made for fastening a discarding sabot, as shown in FIG. 6. Therefore, the outer surfaces of the cavitating projectile ($G_3$) from the leading edge of the cylindrical section 9 to the leading edge 35 of the tail fin stabilizer 32 (from $L_{X2}$ to $L_{X3}$) are underestimated relative to the enveloping contour line (R), but it is a design feature of the cavitating projectile ($G_3$).

The mass of the cavitating projectile ($G_3$) is 75 g when the head portion 1, the central portion 4 with a threaded pin 33 and the bushing 31 with a six-blade tail fin stabilizer 32 are made of easily deformable non-ferrous alloy, namely, of brass with the density $\rho=8.4$ g/cm$^3$, and the disk 34 is made of D16T type aluminum alloy with the density $\rho=2.7$ g/cm$^3$ and tensile strength Rm=450 . . . 500 MPa. The center of mass of the cavitating projectile ($G_3$) is located at the length X=1.60D from the leading edge of the gliding surface 6 at the length (L), this fulfill the condition of this invention (X≥0.3D) and provides rectilinear cavitation movement in the water.

The cavitating projectile ($G_3$) has a length of 4.8D and is stabilized in the air by the aerodynamic drag of the aft portion 5 when fired from a smooth or rifled barrel. Aerodynamic stabilization in the air is achieved by the six-blade tail fin stabilizer 32 with a blade thickness of 1.5 mm and a disk 34, which increases aerodynamic drag, but provides a rapid decrease in the angles of attack of the cavitating projectile after exiting the barrel and a sabot discarding, which is especially necessary when shooting from the air into the water from a short distance. In addition, the disk 34 may be designed for fastening the cavitating core ($G_3$) in the cartridge case of ammunition (see FIG. 6) and sealing a propellant charge, and also for providing obturation of a propellant gas together with a sabot when the cavitating projectile accelerates in the barrel. The gliding surfaces 6 of the tail fin stabilizer 32 with the diameter (D) and the gliding surface 6 of the disc 34 with the diameter (D) may be calibrated together to eliminate their asymmetry. When fired from a rifled barrel, the head portion 1, the central portion 4 with the threaded pin 33 and the disc 34 will rotate. At the same time, the possibility of free rotation of the bushing 31 with the tail fin stabilizer 32 around the threaded pin 33 prevents its joint rotation with the head and central portions when fired from a rifled barrel, which reduces dispersion of cavitating cores in the air and in the water.

The head portion 1 is provided with a narrow circular groove 38 with a minimum diameter $d_1=1.5d$ and an edge 39, which is formed at the conjugation of the rear wall of the circular groove 38 with the outer surface of the head portion 1 of the cavitating core projectile. This groove 38 allows the cavitating core to enter the water when firing at a low angle to the water surface by creating a temporary cavity by means of this edge 39. When the cavitating core projectile enters the water at a small angle to the water surface and the nose surface of the head portion 1 is flushed up to the groove 38: at the same time the edge 39 creates a temporary increased cavity under the cavitating projectile, which prevents flushing of the rest of its surfaces. After the cavitating projectile is immersed into the water, the cavity is formed by the cavitating edge 2 with the diameter (d). Moreover, the narrow circular groove 38 increases the destructive power of the cavitating projectile. In case the head portion 1 is made of an easily deformable material (non-ferrous alloy or low-carbon steel), the nose of head portion 1 bends along the minimum diameter ($d_1$) of the circular groove 38 when it hits a hard obstacle, for example, when it hits a bone tissue of the hunting object. This accelerates the loss of stability of the curved cavitating projectile in the soft tissues of the hunting object. In case the head portion 1 is made of a high-strength material (hardened steel or tungsten alloy), the nose of the head portion 1 breaks off along the minimum diameter ($d_1$) of the circular groove 38 when the cavitating projectile hits a hard target that is located at a small angle to the firing line. At the same time, the edge 39 formed at the conjugation of the rear wall of the circular groove 38, the diameter of which is larger than the cavitating edge diameter (d), interacts with the target that excludes the cavitating projectile ricochet.

During the movement in the cavity formed in the water and gliding the surface 6 along the contour of the cavity (W), the maximum inclination angle (ω) of the cavitating projectile ($G_3$) in the cavity is ω=0.80 with the maximal design gap $\delta_L$=2.30 mm at the length L=80 mm. At the same time, the minimum design gaps $\delta_1$=0.36 mm, $\delta_2$=0.15 mm and $\delta_3$=0.04 mm are formed between the cavity contour (W) and the leading edges of the cylindrical sections 8, 9 and the leading edge 35 of the tail fin stabilizer 32 at the lengths $L_{X1}$=6 mm, $L_{X2}$=16 mm and $L_{X3}$=60 mm respectively. At the same time, in the case of an increase in angular vibrations of the heavy cavitating projectile ($G_3$) in the cavity, there is a possibility of an inertial washing of the gliding surface 6 beyond the cavity contour (W) and the disappearance of the gap ($\delta_3$) with flushing of the outer surface 36 of the tail fin stabilizer 32 from the edge 35 to the projectile caliber (D). This increases the area of the gliding surface and provides additional stability of the cavitating projectile in the cavity, but cannot change its underwater trajectory, since in this case the center of mass will be located at the length $X_1$=0.52D from the leading edge of the gliding surface, which will start from the leading edge 35 of the tail fin stabilizer 32 at the length ($L_{X3}$), that meets the terms of this invention (X≥0.3D) and provides rectilinear cavitation movement in the water.

During the movement in a heterogeneous and compressible aqueous-containing medium, the depth of wetting of the gliding surface 6 and the outer surface 36 of the tail fin stabilizer 32 beyond the cavity contour increases. At the same time, the inclination angle (ω)) of the cavitating projectile increases and the gap ($\delta_2$) that is less than the gap ($\delta_1$) disappears, and the flushing of the surface 9 with subsequent flushing of the thread 37 by the aqueous-containing medium particles makes the cavitating core ($G_3$) lose its cavitation stability and start its overturn in the cavity. At the same time, the gap ($\delta_1$) disappears and the edge 39 forms an enlarged cavity, which contributes to the accelerated overturn of the heavy cavitating projectile ($G_3$), an increase in the contact area with the object of the hunt and its and sharp braking with the transfer of all energy to the hunting object, which significantly increases its stopping power in comparison with the cavitating projectile "prototype".

At a shot in the air or in the water from a dry barrel of a recoilless underwater firearm with 12th gauge ammunition (12/70), the cavitating projectile "prototype" with the mass of 70 g and with an aluminum discarding sabot with the mass of 4 g has a muzzle velocity of 600 m/s, as specified in patents RU 2 651 318 C2 of 19.04.2018 and U.S. Pat. No. 10,591,232 B2 of 17.03.2020 and EP 3 431 915 B1 of 20.10.2021. The cavitating projectile ($G_3$) of the given invention has a mass of 75 g due to a more accurate approximation of its enveloping contour (R) to the contour cavity (W) formed in the water, therefore, its muzzle velocity, considering the mass of the plastic discarding sabot (3 g), will be $V_0$=585 m/s at a similar shot. And its velocity (V) and energy (E) at the underwater range (S) will have the following parameters:

$S$=5 m: $V_5$=496 m/s and $E_5$=9220 Joules:

$S$=10 m: $V_{10}$=421 m/s and $E_{10}$=6650 Joules:

$S$=15 m: $V_{15}$=357 m/s and $E_{15}$=4780 Joules.

These parameters of the cavitating projectile ($G_3$), considering its loss of cavitation stability in soft tissues, can ensure the defeat of a large hunting object. For comparison, the well-known "Brenneke" bullet with the diameter of 18.5 mm and the mass of 31.5 g, which is used in 12th gauge shotgun ammunition (12/70 Magnum) for hunting large animals, has a muzzle velocity and energy $V_0$=460 m/s and $E_0$=3335 Joules, and at a distance of 50 m in has a velocity and energy $V_{50}$=352 m/s and $E_{50}$=1951 Joules, as indicated on a website: Classic|Brenneke-Munition (brenneke-ammunition.de)

An increase in the energy characteristics of a cavitating projectile at the air and underwater trajectory is achieved by increasing its mass when high-density materials based on tungsten or lead are used in its construction.

Moreover, in ammunition designs, where the cavitating projectile with a tail fin stabilizer 32 is fixed with a sabot, and not with a disk 34, it is possible to reduce the outer diameter of the disk 34 to the outer diameter of the bushing 31. This will significantly reduce the aerodynamic drag of the aft part 5 by eliminating the vortex (base) drag of the disk 34, which is designed to quickly reduce the angles of attack of the cavitating projectile when firing from the air into the water from a short air distance. In this design, the bushing 31 and the tail fin stabilizer 32 may be made of an aluminum alloy with the density ρ=2.7 g/cm$^3$, which will provide an additional displacement of the center of mass of the cavitating projectile ($G_3$) to the head portion 1 and ensure its stability in the air and in the water without a disk 34.

FIG. 6 shows a schematic view of a fragment of 12th gauge shotgun ammunition (12/70) with a fastened cavitating projectile ($G_4$). The ammunition includes: a brass cartridge case 40 with a primer and propellant charge 41, in the neck of which a cavitating core ($G_4$) with a discarding sabot 42 is fastened. Dimensions of the outer surfaces of the head portion 1 and the central portion 4 of the cavitating projectile ($G_4$), as well as its length and caliber (D) at the length (L) are equal to those of the cavitating projectile ($G_3$). In this case, the aft portion 5 of the cavitating projectile ($G_4$) is made in the form of a combination of two truncated cones (E) and (F), where the larger base of the cone (F) is conjugated with the gliding surface 6, the contour of which corresponds to the gliding surface 6 with a cylindrical tail section (disc 34) of the cavitating projectile ($G_3$). At the same time, the diameter of the conjugation ($D_{X34}$) of the two truncated cones (E) and (F) at the length ($L_{X3}$) is 5% less than the diameter ($D_{X3}$) at the length ($L_{X3}$) of the cavitating projectile ($G_3$). The reduced mating diameter ($D_{X34}$) excludes flushing and gliding of the outer surface of the truncated cone (F) during the movement in the cavity formed in the water, because the center of mass of the cavitating projectile ($G_3$) should be located at the length X≥0.3D in front of the leading edge of the gliding surface 6 located at the length (L) according to the terms of this invention.

The mass of the cavitating projectile ($G_4$) is 120 g when its jacket 43 is made of an easily deformable non-ferrous alloy, namely, of brass with the density ρ=8.4 g/cm$^3$ and filled with lead 44 with the density ρ=11.3 g/cm$^3$. The base pocket 45 allows placing a part of the propellant charge 41 in it and shifts the center of mass of the cavitating projectile to the head at the length X=0.97D from the leading edge of the gliding surface 6 located at the length (L), which provides rectilinear cavitation movement in the water.

The discarding sabot 42 has the mass of 3 g when made of the PA-6 type plastic with the tensile strength Rm=65 . . . 70 MPa and the density ρ=1.12 . . . 1.15 g/cm$^3$, and the diameter of its outer surface ($D_3$) is equal to the caliber (D) of the cavitating projectile. The symmetry of the outer surface of the sabot 42 with the diameter ($D_3$) and the gliding surface 6 with the diameter (D) is ensured by fastening the sabot 42 on the thread 37 with fixation on the conical surface 46.

The cavitating projectile ($G_4$) is fastened into the cartridge case 40 by its gliding surface 6. Similarly, the cavitating projectile ($G_3$) is fastened into the cartridge case 40 by its gliding surface 6 of the disc 34. At the length of the cavitating projectiles ($G_3$) and ($G_4$) equal to 4.8D, the length of the ammunition is 150 mm and exceeds the standard length of the 12th gauge shotgun ammunition (12/70 and 12/76), but this is permissible at manual loading of a recoilless underwater firearm. During a shot, the obturation of the propellant gas in the barrel is provided by the gliding surface 6 and the sabot 42.

At a shot in the air from a smooth barrel, the cavitating projectile ($G_4$) is stabilized by the aerodynamic resistance of the aft portion 5 and the plastic sabot 42 that cannot separate along three narrow longitudinal slots 47 without a centrifugal rotation force. But, when the plastic sabot 42 enters the water it separates along three narrow longitudinal slots 47 due to the hydraulic resistance of the water and discards from the cavitating projectile. Of course, the plastic sabot 42 significantly increases the aerodynamic drag, but this is acceptable when shooting from the air into the water at a short distance. At a shot in the air from a rifled barrel, the cavitating projectile ($G_4$) is stabilized by spin after the sabot 42 separates along three narrow longitudinal slots 47 due to the centrifugal rotation forces and discards from the cavitating projectile.

Cavitation movement in the cavity formed in the water and loss of cavitation stability in a heterogeneous and compressible aqueous-containing medium of the cavitating projectile ($G_4$) is similar to the cavitating projectile ($G_3$), since they have an identical enveloping contour line (R) and the dimensions of outer surfaces, except for the diameter ($D_{X34}$) at the length ($L_{X3}$).

The cavitating projectile ($G_4$) has a bigger mass and lower muzzle velocity, but more energy on the underwater trajectory, than the cavitating projectile ($G_3$). At a shot in the air or in the water from a dry barrel of the recoilless underwater firearm, the cavitating projectile ($G_4$) with the mass of 120 g with the discarding sabot with the mass of 3 g will have a muzzle velocity $V_0$=465 m/s, considering the speed of the free rollback of the barrel, and its velocity (V) and energy (E) at underwater range (S) will have the following parameters:

$$S=5\text{ m: } V_5=420\text{ m/s and } E_5=10580\text{ Joules:}$$

$$S=10\text{ m: } V_{10}=380\text{ m/s and } E_{10}=8660\text{ Joules:}$$

$$S=15\text{ m: } V_{15}=345\text{ m/s and } E_{15}=7140\text{ Joules.}$$

This example shows that the cavitating projectile ($G_4$) with a bigger mass has by 30-50% bigger energy parameters at the underwater trajectory than the cavitating projectile ($G_3$).

Comparison of the enveloping contour (R) of the cavitating projectile ($G_3$ or $G_4$) of the given invention and it "analog" shows that the enveloping contour (R) of the "analog" is limited by the diameter 0.4D=7.4 mm at the length of 0.4D. But in the cavitating projectile ($G_3$) or ($G_4$), the enveloping contour (R) is limited by the diameter $D_X$=7.68 mm at the length $L_X$=0.4D. This shows that the enveloping contour (R) of the given invention is closer to the cavity contour (W) than the enveloping contour (R) of the "analog".

Comparative calculation of the enveloping contour line (R) of the cavitating projectile ($G_3$ or $G_4$) using the "prototype" equation:

$$D_X=d\times[1+(L_X/d)\times(2\sin\varphi/\pi)^{1/N}]^N$$

shows that at sizes: d=3.15 mm, φ=120° and N=0.478 between the cavity contour (W) and caliber D=18.5 mm of the cavitating projectile "prototype", the design gap $\delta_L$=2.30 mm and the maximal inclination angle ω=0.80 at the length L=80 mm are formed. And the minimum design gaps are $\delta_1$=0.84 mm, $\delta_2$=0.72 mm and $\delta_3$=0.24 mm that can be formed between the enveloping contour (R) and the cavity contour (W) at the lengths $L_{X1}$=6 mm, $L_{X2}$=16 mm and $L_{X3}$=60 mm, respectively.

This calculation shows that in the cavitating projectile "prototype" the gaps ($\delta_1$), ($\delta_2$) and ($\delta_3$) are 2.3, 4.8 and 6 times bigger than the gaps ($\delta_1$), ($\delta_2$) and ($\delta_3$) in the given invention. This provides a stable cavitation movement of the cavitating projectile "prototype" in the cavity formed in the water and in a heterogeneous and compressible aqueous-containing medium, which was confirmed by comparative shooting into ballistic gelatin blocks with cavitating projectiles "prototype" and cavitating projectiles of the given invention.

Analysis of the enveloping contour line (R) of the cavitating projectile ($G_3$ or $G_4$) using a cavity equation from the well-known "RAMICS" presentation shown on the website: www.scribd.com/document/342233681/30x173-for-RAMICS where the cavity equation looks like:

$$y=d/2\sqrt{(kx/d)+1}\text{, wherein:}$$

- y=R=½ D—is a current radius of a cross-sections of a formed cavity at a-current length (x), in millimeters;
- d—is a diameter of a cavitating edge, in millimeters;
- k=2 $c_X$=2 sin φ/π—is a doubled cavitation drag index ($c_X$) for a nose surface that made in a form of a flat face (φ=180°);
- x—is a current length ($L_X$) of the formed cavity from the cavitating edge, in millimeters, shows that when the surface 6 is glided along the cavity contour (W), the design gap $\delta_L$=1.10 mm and the maximum inclination angle φ=0.4° at the length L=80 mm are formed. At the same time, the negative minimum design gaps ($\delta_1$=−0.61 mm, $\delta_2$=−0.60 mm and $\delta_3$=−0.18 mm) will be formed between the enveloping contour (R) and the cavity contour (W) at the lengths $L_{X1}$=6 mm, $L_{X2}$=16 mm and $L_{X3}$=60 mm, respectively.

This analysis shows that the calculated cavity equation in the "RAMICS" presentation is underestimated relative to the actual cavity contour (W), which in principle does not allow creating the enveloping contour line (R) of the cavitating core of the given invention using the cavity equation from the "RAMICS" presentation.

The presented examples show that the given invention improves the efficiency of the cavitating projectile by approaching the contour of its outer surface to the cavity contour (W) formed in the water, increasing its mass and improving its stopping power due to the loss of its cavitation stability and overturn in inhomogeneous (heterogeneous) and a compressible aqueous-containing medium with increasing the area of contact with the target.

INDUSTRIAL APPLICABILITY

Cavitating projectiles of firearm ammunition according to the invention can be used for underwater hunting and for protection against attacks by predators in the water when firing from existing and perspective small arms and hunting guns, as well as when using the device for underwater firing from small arms according patent RU 2 733 018 C1 of 28.09.2020 and publication of international application WO 2021/167489 A1 of 26.08.2021. Ammunition with cavitating projectile can be included in the allowance of ammunition of combat swimmers, marines, coast guards, ship staff and naval aviation crews.

Ammunition with cavitating projectile can be used to defend sea and coastal objects from attacks by underwater, surface and air attack weapons when firing from existing and prospective machine guns and cannon armaments of aviation, ships and submarines, as well as when using the device for underwater firing from a firearm according patents RU 2 498 189 C2 of 10.11.2013 and U.S. Pat. No. 8,919,020 B2 of 30.12.2014 and EP 2 690 390 B1 of 10.08.2016, as well as when using the recoilless underwater firearm according patents RU 2 651 318 C2 of 19.04.2018 and U.S. Pat. No. 10,591,232 B2 of 17.03.2020 and EP 3 431 915 B1 of 20.10.2021.

The invention can be used in designs of jet weapons intended for flight in the air and/or cavitation movement in the water.

The invention claimed is:

1. A cavitating projectile of firearm ammunition comprising:

a head portion conjugated with a secant nose surface having a cavitating edge;

a central portion; and an aft portion with a gliding surface configured to stabilize the cavitating projectile in a cavity due to one-sided periodic wetting and gliding along a contour (W) of the cavity;

wherein a caliber (D) of the projectile is defined by a maximum diameter of a circle circumscribing the cross-section of the gliding surface;

wherein, in a plane of an axial longitudinal section of the projectile, a diameter ($D_X$) of an enveloping contour line (R) extending from the cavitating edge to the cross-section of the gliding surface is limited by the equation:

$$D_X=d*[1+(L_X/d)*2\pi*\sin\varphi/\pi]^N,$$ wherein:

$D_X$ is the diameter of the enveloping contour line (R) at a length ($L_X$) from the cavitating edge, in millimeters;

d is a diameter of the cavitating edge, in millimeters;

$L_X$ is the length from the cavitating edge, in millimeters;

φ is an apex angle, in a range of 60° to 180°, of tangents to the secant nose surface at points of conjugation of the secant nose surface with the cavitating edge measured from a side of the head portion; and N is a cavitating projectile volume factor in a range of 0.25 to 0.40; and wherein the caliber (D) of the projectile is equal to the diameter ($D_X$) of the enveloping contour line (R) when $L_X$=L, where L is a length from the cavitating edge to a leading edge of the gliding surface, and a center of mass of the projectile is located at a length (X) in front of the leading edge of the gliding surface, where X>0.3D.

2. The cavitating projectile in accordance with claim 1, wherein the secant nose surface is made in the form chosen from the group consisting of: a flat face, a cone, a cone with a rounded top, a truncated cone, and a truncated cone with a rounded edge of a smaller base.

3. The cavitating projectile in accordance with claim 1, wherein a narrow circular groove, a minimum diameter of which is 1.3 to 1.8 times the diameter (d) of the cavitating edge, is made in the head portion.

4. The cavitating projectile in accordance with claim 1, wherein the aft portion is made in the form of a multi-blade tail fin stabilizer and is equipped with a cylindrical tail section configured for fastening the projectile in the firearm ammunition.

5. The cavitating projectile in accordance with claim 1, wherein the aft portion is made in the form of a multi-blade tail fin stabilizer and is capable of free rotation around a longitudinal axis of the projectile.

6. The cavitating projectile in accordance with claim 1, wherein the head portion and the central portion are equipped with a protective cap that is discarded during acceleration of the projectile in a barrel.

7. The cavitating projectile in accordance with claim 1, further comprising a discarding sabot forward of the gliding surface and configured to lead the projectile during acceleration of the projectile in a barrel and to stabilize the projectile during flight before being discarded when the projectile enters water.

* * * * *